US005353964A

United States Patent [19]

Liu et al.

[11] Patent Number: 5,353,964

[45] Date of Patent: Oct. 11, 1994

[54] TWIN-BOTTLE NURSING BOTTLE

[76] Inventors: Yin-Peng Liu, No. 149 Charng Show Street; Miin-Tsang Sheu, No. 156 Cheng Kung Road, both of Chang Hua City, Taiwan

[21] Appl. No.: 197,764

[22] Filed: Feb. 16, 1994

[51] Int. Cl.[5] ..... B67D 5/60

[52] U.S. Cl. ..... 222/134; 222/144.5; 222/192; 215/11.4; 73/426

[58] Field of Search ..... 222/192, 144.5, 134, 222/145, 490; 606/234, 235, 236; 73/426; 215/11.1, 11.4

[56] References Cited

U.S. PATENT DOCUMENTS

| | | | |
|---|---|---|---|
| 2,745,568 | 5/1956 | Newton | 215/11.4 |
| 4,585,149 | 4/1986 | Zulauf | 222/144.5 X |
| 4,893,729 | 1/1990 | Iggulden et al. | 222/144.5 X |
| 5,152,431 | 10/1992 | Gardner et al. | 222/144.5 X |
| 5,244,122 | 9/1993 | Botts | 222/490 X |

*Primary Examiner*—Gregory L. Huson
*Attorney, Agent, or Firm*—Bacon & Thomas

[57] ABSTRACT

A twin-bottle nursing bottle includes an outer bottle having a mouth at the top; an outer cap fastened to the mouth of the outer bottle through a screw joint to hold a nipple; an inner bottle disposed inside the outer bottle; a cup-like inner cap supported above the mouth of the outer bottle to hold the inner bottle inside the outer bottle; and a diversion control switch received within the outer cap between the nipple and the cup-like inner cap and turned to let a first fluid in the outer bottle or a second fluid in the inner bottle flow into the nipple for suction by the baby or to let both the first and second fluids flow into the nipple simultaneously.

3 Claims, 4 Drawing Sheets

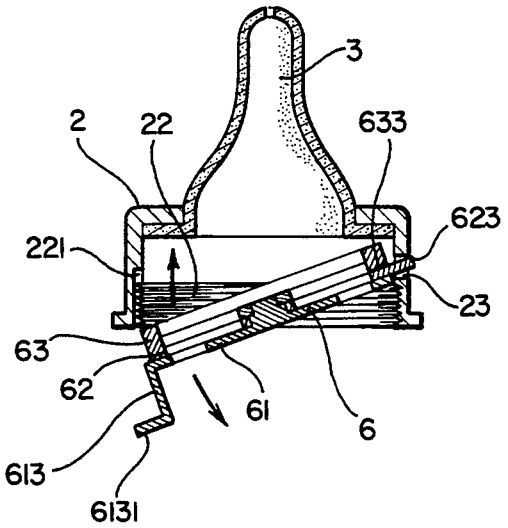
FIG. 2-A
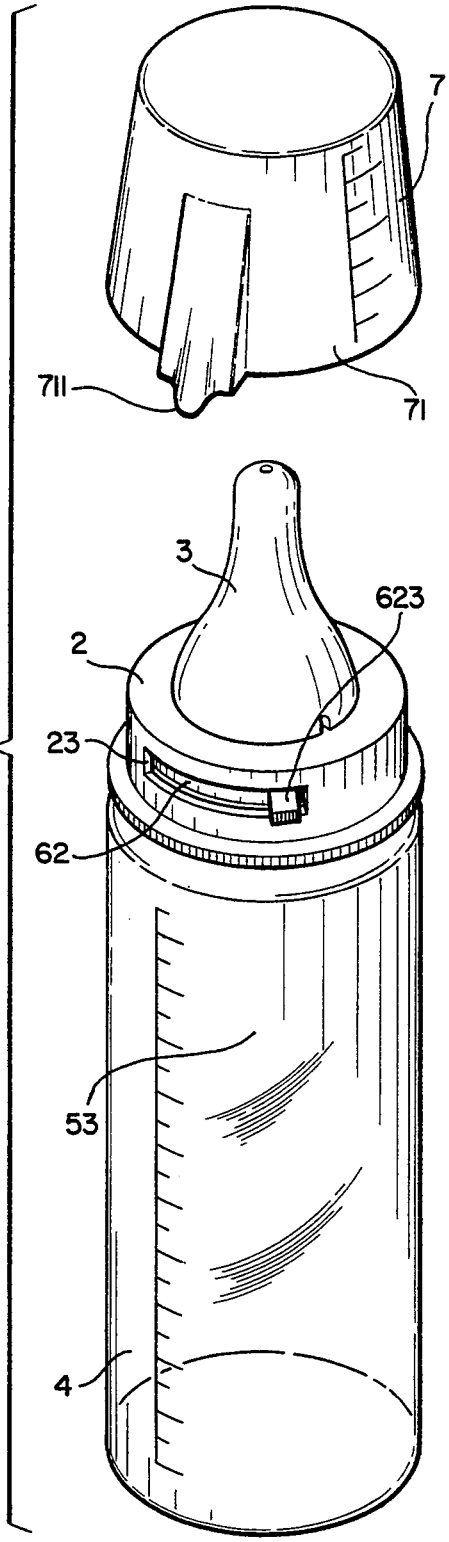
FIG. 2
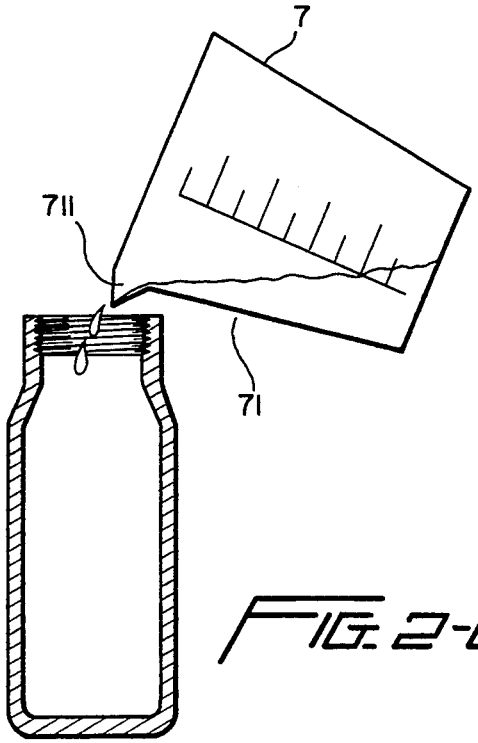
FIG. 2-B

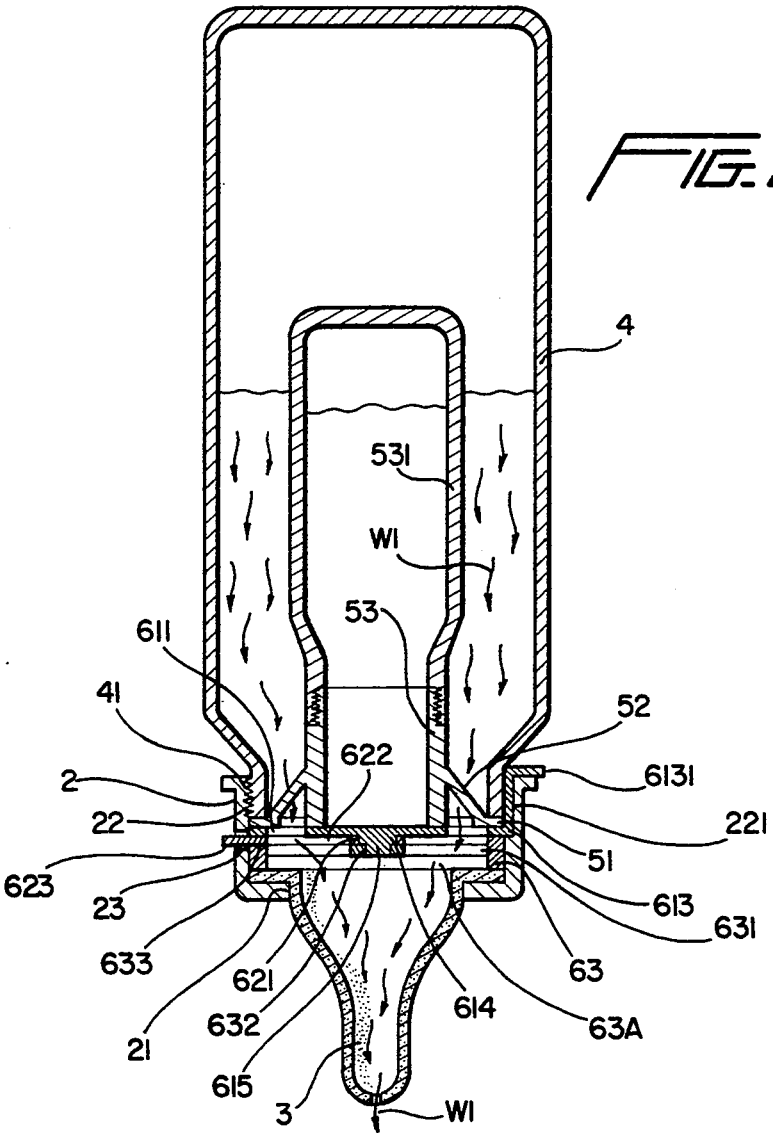
FIG. 3-A
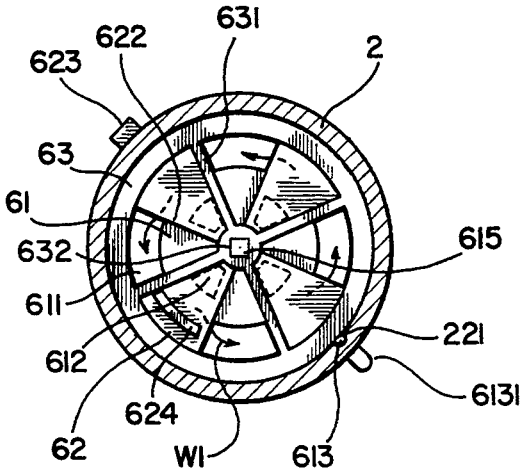
FIG. 3-B
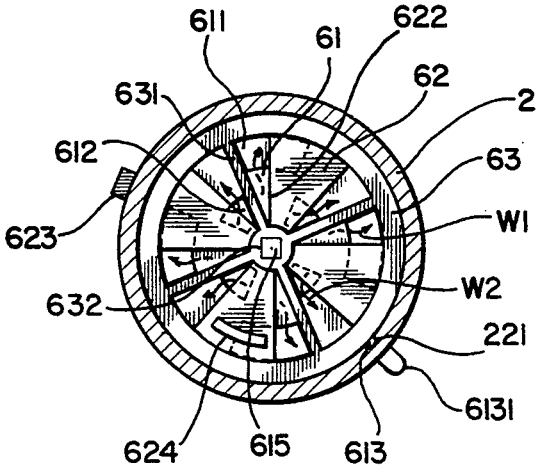
FIG. 5

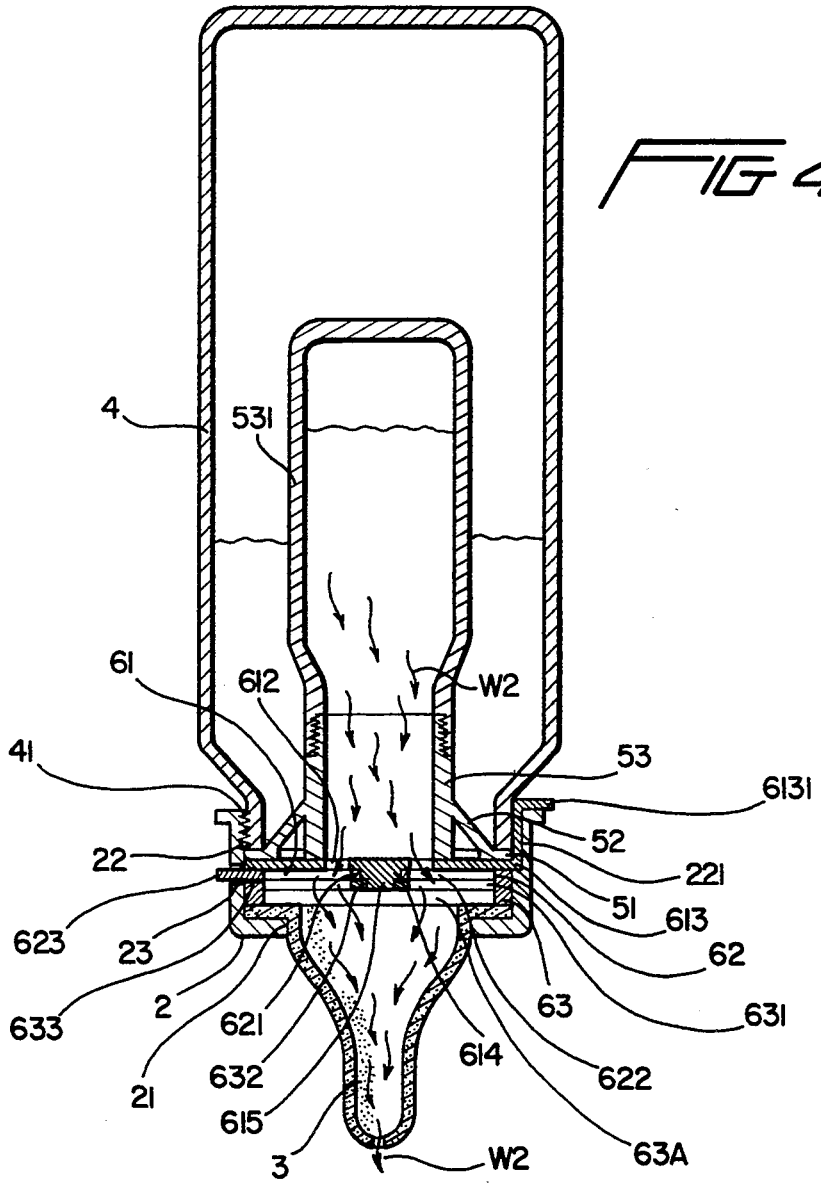
FIG 4-A
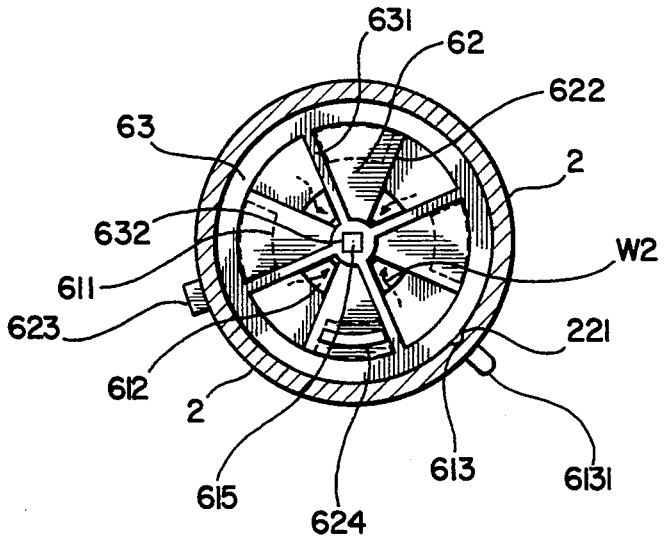
FIG. 4-B

TWIN-BOTTLE NURSING BOTTLE

BACKGROUND OF THE INVENTION

The present invention relates to nursing bottles, and more particularly to a twin-bottle nursing bottle which includes two bottles connected one inside the other, and a switch controlled to let the fluid in either bottle flow into the nipple for suction by the baby or to let both fluids in both bottles flow into the nipple simultaneously.

Nursing bottles are commonly used to feed babies with water, milk, juice, medicine, or any of a variety of eatable fluids. A normal nursing bottle is generally comprised of a bottle, a nipple, and a cap fastened to the mouth of the bottle to hold the nipple in place. This structure of nursing bottle can only be used for feeding one fluid or mixed fluid. Therefore, a mother or nursery may have to prepare several nursing bottles for feeding a baby with different fluids. When feeding a baby with a medicine, the baby may refuse to take the medicine. In order to coax the baby to take the medicine, the mother or nursery may alternatively feed the baby with milk, juice, or a sweat fluid during the interval. However, it is not conveniently to feed a baby with different fluids. While changing from one nursing bottle to another during the action of feeding, the nursing bottles may slip from the hands or drop to the floor. Besides, when several nursing bottles are prepared, the sterilization process is relatively complicated. Furthermore, preparing several nursing bottles costs a lot.

SUMMARY OF THE INVENTION

The present invention has been accomplished under the aforesaid circumstances. It is therefore the principal object of the present invention to provide a twin-bottle nursing bottle which is practical for feeding two different fluids to a baby alternatively by means of the control of a diversion switch. It is another object of the present invention to provide a twin-bottle nursing bottle which can be conveniently operated to alternatively feed a baby with different fluids.

According to one aspect of the present invention, the twin-bottle nursing bottle comprises an outer bottle having a mouth at the top, an outer cap fastened to the mouth of the outer bottle through a screw joint to hold a nipple, an inner bottle disposed inside the outer bottle, a cup-like inner cap supported above the mouth of the outer bottle to hold the inner bottle inside the outer bottle, and a diversion control switch received within the outer cap between the nipple and the cup-like inner cap and turned to let a first fluid in the outer bottle or a second fluid in the inner bottle flow into the nipple for suction by the baby or to let both the first and second fluids flow into the nipple simultaneously.

According to another aspect of the present invention, the diversion control switch is comprised of a diversion plate, a shutter plate having a finger rod extended out of the outer cap, and a locating plate fastened within the outer cap to hold the diversion plate and the shutter plate in place, wherein turning the finger rod of the shutter plate to the left limit position, a first route is formed for letting the fluid in the outer bottle flow into the nipple; turning the finger rod of the shutter plate to the right limit position, a second route is formed for letting the fluid in the inner bottle flow into the nipple; turning the finger rod of the shutter plate to the midway position, a third route is formed for letting the fluid in the outer bottle and the fluid in the inner bottle flow into the nipple simultaneously.

BRIEF DESCRIPTION OF THE DRAWINGS

The present invention will now be described by way of example with reference to the annexed drawings, in which:

FIG. 2 is an elevational view of the twin-bottle nursing bottle shown in FIG. 1;

FIG. 2A shows the switch of the twin-bottle nursing bottle shown in FIG. 2 released from the outer cap thereof;

FIG. 2B is an applied view of the measuring cup according to the present invention;

FIG. 3A is a longitudinal view in section of the twin-bottle nursing bottle shown in FIG. 2, showing the passage holes on the shutter plate aligned with the outer feeding holes;

FIG. 3B is a cross section of the switch taken on FIG. 3A;

FIG. 4A is similar to FIG. 3A but showing the passage holes on the shutter plate aligned with the inner feeding holes on the diversion plate;

FIG. 4B is a cross section of the switch taken on FIG. 4A; and

FIG. 5 is a cross section of the switch showing the passage holes on the shutter plate partially aligned with the outer feeding holes and the inner feeding holes.

DETAILED DESCRIPTION OF THE PREFERRED EMBODIMENT

Figure 1:
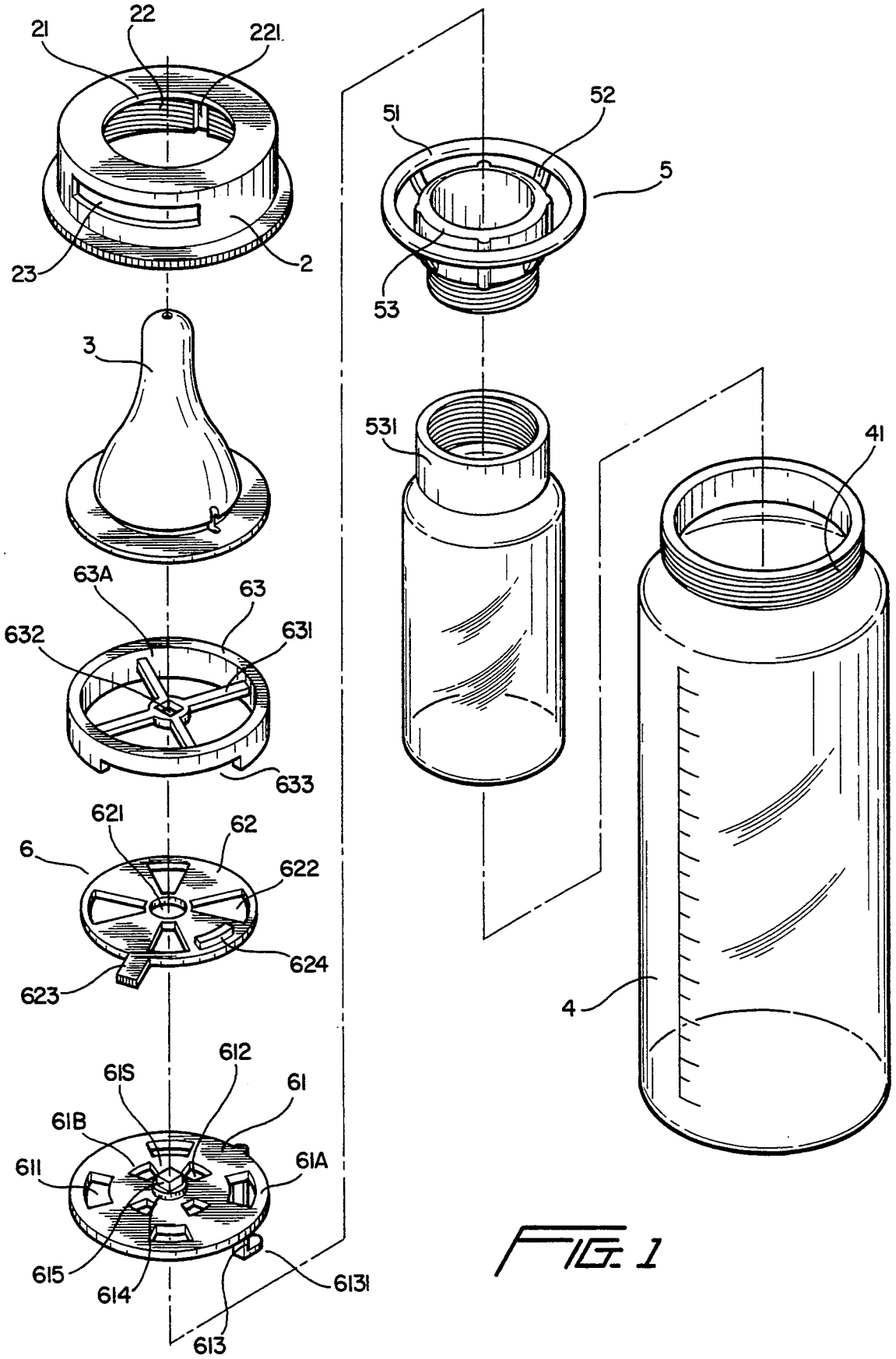
FIG. 1 is an exploded view of a twin-bottle nursing bottle according to the preferred embodiment of the present invention.

Referring to FIGS. 1, 2, and 3A, a twin-bottle nursing bottle in accordance with the present invention is generally comprised of an outer cap 2, a nipple 3, an outer bottle 4, an inner bottle 5, and a switch 6.

The outer cap 2 comprises a center opening 21, through which the nipple 3 protrudes, an inner thread 22 threaded onto the outer thread 41 on the mouth of the outer bottle 4, an elongated horizontal slot 23 at one side in the middle, and a vertical inside groove 221 opposite to the elongated horizontal slot 23.

The inner bottle 5 comprises a bottle body 531 and a cup-like inner cap 53 fastened to the mouth of the bottle body 531. The cup-like inner cap 53 of the inner bottle 5 comprises a locating ring 51 connected to the cap body thereof by radial ribs 52. The mouth of the cup-like inner cap 53 is disposed at an elevation not lower than that of the locating ring 51.

The switch 6 is received within the outer cap 2 between the nipple 3 and the locating ring 51 of the cup-like inner cap 53 of the inner bottle 5. Before the outer cap 2 is fastened to the outer bottle 4, the inner bottle 5 is inserted into the mouth of the outer bottle 4 permitting the locating ring 51 of the cup-like inner cap 53 to be stopped above the mouth of the outer bottle. After the switch 6 has been mounted on the locating ring 51, the nipple 3 is attached to the outer cap 2 and then the outer cap 2 is fastened to the outer bottle 4 to hold down the switch 6 and the nipple 3. The switch 6 is comprised of a diversion plate 61, a shutter plate 62, and a locating plate 63. The diversion plate 61 is made of flat, circular shape comprised of an inner bearing portion 61B supported on the mouth of the cup-like inner cap 53, and a peripheral bearing portion 61A surrounding the inner bearing portion 61B and supported on the locating ring 51. The peripheral bearing portion 61A comprises a plurality of equiangularly spaced outer feeding holes 611 (there are shown four outer feeding holes 611, and the contained angle between either two outer feeding holes 611 is slightly smaller than 45° angle), a locating rib 613 vertically and downwardly extended from the border at a suitable location and terminating in an outward projection 6131. When installed, the projecting rib 613 engages into the vertical inside groove 221 on the outer cap 2 for positioning, permitting the outward projection 6131 to extend out of the outer cap 2. By pulling the outward projection 6131, the switch 6 can be conveniently dismantled (see FIG. 2A). The inner bearing portion 61B comprises a stub round rod 614 in the center, a polygonal shaft 615 raised from the stub round rod 614 at the top, and a plurality of inner feeding holes 612 equiangularly spaced around the stub round rod 614. The shutter plate 62 is made of flat, circular shape comprising a center round hole 621, which receives the stub round rod 614 of the diversion plate 61, a plurality of passage holes 622 spaced around the center round hole 621, a finger rod 623 extended from the periphery thereof, and a stop block 624 disposed at the top between two passage holes. By moving the finger rod 623 in either direction, the passage holes 622 can be aligned with the outer feeding holes 611 or inner feeding holes 612. When the passage holes 622 and the outer feeding holes 611 are aligned respectively, the inner feeding holes 612 are blocked (see FIG. 3B); when the passage holes 622 and the inner feeding holes 612 are aligned respectively, the outer feeding holes 611 are blocked (see FIG. 4B). The locating plate 63 is made of annular-shape and provided to hold the shutter plate 62 on the inside, comprising intersected ribs 631 on the inside, a polygonal center hole 632 in the center of the intersected ribs 631, which receives the polygonal shaft 615 of the diversion plate 61, and a side opening 633, through which the finger rod 623 extends to the outside. When installed, the intersected ribs 631 are disposed above the shutter plate 62 to support the nipple 3 and aimed at the radial surface area 61S on the diversion plate 61 between the outer feeding holes 611 and the inner feeding holes 612; the stop block 624 is inserted into either opening among the intersected ribs 631; a fluid passage way 63A is defined within the locating plate 63 for guiding a fluid from the outer feeding holes 611 or the inner feeding holes 612 into the nipple 3. When the finger rod 623 of the shutter plate 62 is moved in either direction, the stop block 624 will be stopped at one side causing the passage holes 622 of the shutter plate 62 aligned with the outer feeding holes 611 (see FIG. 3B), and therefore the inner feeding holes 612 are blocked; when the finger rod 623 of the shutter plate 62 is moved in the reversed direction, the stop block 624 will be stopped at an opposite side causing the passage holes 622 of the shutter plate 62 aligned with the inner feeding holes 612 (see FIG. 4B, and therefore the outer feeding holes 611 are blocked.

Because the mouth of the cup-like inner cap 53 is closely stopped at the diversion plate 61 between the peripheral bearing portion 61A and the inner bearing portion 61B, the outer feeding holes 611 and the inner feeding holes 612 are separated. Different fluids may be separately filled into the outer bottle 4 and the cup-like inner cap 53 of the inner bottle 5. Before feeding, the finger rod 623 of the shutter plate 62 is moved to one side (where a mark may be marked) causing the passage holes 622 aligned with the outer feeding holes 611 (the inner feeding holes 612 blocked), and therefore the fluid W1 in the outer bottle 4 is allowed to pass through the outer feeding holes 611, the passage holes 622, and the fluid passage way 63A, into the 15 nipple 3 for suction by the baby (see FIGS. 3A and 3B). When the fluid W1 in the outer bottle 4 has been completely taken up by the baby, the finger rod 623 of the shutter plate 62 may be moved to the opposite side permitting the passage holes 622 to be aligned with the inner feeding holes 612. When the passage holes 622 and the inner feeding holes 612 are aligned, the fluid W2 in the inner bottle 5 is allowed to pass through the outer feeding holes 611, the passage holes 622, and the fluid passage way 63A, into the nipple 3 for suction by the baby (see FIGS. 4A and 4B).

When to change the feeding from the fluid W1 in the outer bottle 4 to the fluid W2 in the inner bottle 5, the outer bottle 4 must be turned to the upright position, before the shutter plate 62 is shifted to the opposite position, to let the residual fluid W1 (or W2) flow back into the outer bottle 4 (or the cup-like inner cap 53), and therefore the fluids W1 and W2 are prohibited from being mixed together.

The fluids W1 and W2 may be mixed together during the feeding action. When the finger rod 623 is moved to the midway position, the passage holes 622 are partially aligned with the outer feeding holes 611 and partially aligned with the inner feeding holes 612 (see FIG. 5), and therefore the fluids W1 and W2 are allowed to pass through the passage holes 622 into the nipple 3. The inner bottle 5 may be used to carry a medicine, and the outer bottle 4 may be used to carry milk, juice, or drinking water. If the baby refuses to suck in the medicine during the feeding action, the shuttle plate 62 may be shifted to let milk, juice, or drinking water be guided into the nipple 3 for sucking by the baby, and therefore the medicine can be smoothly fed to the baby. Further, while feeding a baby with a medicine by means of the cup-like inner cap 53, drinking water may be alternatively fed to the baby to help the baby take up the medicine and simultaneously to dilute the medicine.

Because the installation of the inner bottle 5 in the outer bottle 4 relatively reduces the workable volume of the outer bottle 4, the size of the outer bottle 4 may be relatively increased. The cup-like inner cap 53 may be fastened to the bottle body 531 through a screw joint so that the bottle body 531 is replaceable. Alternatively, the cup-like inner cap 53 may be directly molded on the bottle body 531.

Referring to FIGS. 2 and 2B, there is also provided a measuring cup 7 detachably covered on the outer cap 2 over the nipple 3, having a projecting peripheral wall portion 71 for receiving the finger rod 623, and a spout 711 raised from the projecting peripheral wall portion 71. When feeding a baby with a medicine, the measuring cup 7 can be used to measure the amount of the medicine and then to take the measured amount of the medicine into the bottle body 531 of the inner bottle.

What is claimed is:

1. A nursing bottle comprising:

an outer bottle having a mouth at the top;

an outer cap fastened to the mouth of said outer bottle through a screw joint to hold a nipple, said outer cap comprising an elongated horizontal slot and a vertical inside groove;

an inner bottle disposed inside said outer bottle, said inner bottle comprising a bottle body having a mouth at the top, a cup-like inner cap fastened to the mouth of the bottle body of said inner bottle, said cup-like inner cap comprising a cap body, a locating ring spaced around the cap body of said cup-like inner cap and retained between the mouth of said outer bottle and said nipple by said outer cap, and radial ribs connected between the cap body and locating ring of said cup-like inner cap, the cap body of said cup-like inner cap having a top mouth disposed at an elevation not lower than the topmost surface of said locating ring; and switch means received within said outer cap between said nipple and said locating ring and controlled to let a first fluid in said outer bottle or a second fluid from said inner bottle flow into said nipple for suction by the baby or to let both said first and second fluids flow into said nipple simultaneously.

2. The nursing bottle of claim 1 wherein said switch means comprises:

a diversion plate made of flat, circular shape comprised of an inner bearing portion supported on the top mouth of the cap body of said cup-like inner cap, and a peripheral bearing portion surrounding said inner bearing portion and supported on said locating ring, said peripheral bearing portion comprising a plurality of equiangularly spaced outer feeding holes, a downward locating rib engaged into the vertical inside groove on said outer cap and terminating in an outward projection disposed outside said outer cap, said inner bearing portion comprising a stub round rod in the center, a polygonal shaft raised from said stub round rod at the top, and a plurality of inner feeding holes equiangularly spaced around said stub round rod;

a shutter plate made of flat, circular shape supported on said diversion plate, said shutter plate comprising a center round hole, which receives said stub round rod of said diversion plate, a plurality of passage holes spaced around the center round hole of said shutter plate, a finger rod extended out of said outer cap through said horizontal slot, and a stop block disposed at the top; and a locating plate covered over said shutter plate and retained within said outer cap, said locating plate being made of annular shape, comprising intersected ribs on the inside defining a plurality of open spaces, a polygonal center hole in the center of said intersected ribs, which receives said polygonal shaft of said diversion plate, and a side opening, through which said finger rod of said shutter plate extends out of said outer cap; and whereby when said finger rod of said shutter plate is moved in one direction to stop said stop block at a left limit position, said passage holes of said shutter plate are aligned with said outer feeding hole and said inner feeding holes are blocked for permitting the fluid in said outer bottle to be guided into said nipple; when said finger rod of said shutter plate is moved in the reversed direction to stop said stop block at a right limit position, said passage holes of said shutter plate are aligned with said inner feeding holes and said outer feeding holes are blocked for permitting the fluid in said inner bottle to be guided into said nipple; when said finger rod of said shutter plate is moved to a midway position between said left limit position and said right limit position, said passage holes of said shutter plate are partially aligned with said inner feeding holes and said outer feeding holes for permitting the fluid in said inner bottle and the fluid in said outer bottle to be simultaneously guided into said nipple.

3. The nursing bottle of claim 1 further comprising a measuring cup detachably covered on said outer cap over said nipple, said measuring cup having a projecting peripheral wall portion for receiving said finger rod, and a spout raised from said projecting peripheral wall portion.

* * * * *